US009612085B2

(12) United States Patent
Powell et al.

(10) Patent No.: US 9,612,085 B2
(45) Date of Patent: Apr. 4, 2017

(54) PAYLOAD LAUNCH SYSTEM AND METHOD

(71) Applicant: Sparton Corporation, Schaumburg, IL (US)

(72) Inventors: David Powell, Sanford, FL (US); Earl Mark, Deleon Springs, FL (US); Keith Huber, Palm Coast, FL (US); Taylor Durrance, Daytona Beach, FL (US); Tanner Sizemore, Wildwood, FL (US); Charles M. Nowell, Jr., Longwood, FL (US)

(73) Assignee: Sparton Corporation, Schaumburg, IL (US)

( * ) Notice: Subject to any disclaimer, the term of this patent is extended or adjusted under 35 U.S.C. 154(b) by 199 days.

(21) Appl. No.: 14/605,397

(22) Filed: Jan. 26, 2015

(65) Prior Publication Data

US 2016/0178317 A1 Jun. 23, 2016

Related U.S. Application Data

(60) Provisional application No. 61/932,015, filed on Jan. 27, 2014.

(51) Int. Cl.
*F41F 3/07* (2006.01)
*F41F 3/077* (2006.01)

(52) U.S. Cl.
CPC ..... *F41F 3/07* (2013.01); *F41F 3/077* (2013.01)

(58) Field of Classification Search
CPC .... F41F 3/07; F41F 3/073; F41F 3/077; F41F 3/052; F41F 3/06; F41F 3/065; F41F 3/08; F41F 3/10; B63G 8/30
USPC ..... 89/1.81, 1.801, 1.803, 1.806, 1.807, 89/1.809, 1.811, 1.812, 1.816, 1.817, 89/1.819, 5; 114/20.1, 21.1, 21.2; 244/63
See application file for complete search history.

(56) References Cited

U.S. PATENT DOCUMENTS 1,418,795 A * 6/1922 Hammond, Jr. ..... F41F 3/08 114/18
3,583,277 A * 6/1971 Crockett ..... F41F 3/04 89/1.8
4,523,538 A * 6/1985 Hollmann ..... F41F 3/10 114/238
5,208,422 A * 5/1993 Moody ..... F41F 3/10 114/238

(Continued)

*Primary Examiner* — John D Cooper
(74) *Attorney, Agent, or Firm* — Quinn IP Law

(57) ABSTRACT

A payload launch system includes a launch tube, payload, rocket tube, pressurized motor assembly, and control system. The motor assembly has a launch actuator and an accumulator housing containing compressed gas. The accumulator housing defines a vent opening having a closure. The control system transmits an actuation signal to the actuator in response to a launch request signal to open the closure and cause a discharge of pressure into the launch tube. This causes the rocket tube to launch from the launch tube to a threshold altitude in a single gaseous thrust phase. A method includes deploying a launch system, transmitting a launch actuation signal to the launch actuator via a control system, and opening a closure to allow compressed gas to enter the launch tube, thereby launching the rocket tube from the launch tube to a threshold altitude in the single gaseous thrust phase.

20 Claims, 5 Drawing Sheets

(56) References Cited

U.S. PATENT DOCUMENTS

| | | | | |
|---|---|---|---|---|
| 6,318,229 | B1 * | 11/2001 | Nevels | F41F 3/04 89/1.81 |
| 6,427,574 | B1 * | 8/2002 | Callahan | F41F 3/07 89/1.81 |
| 6,502,528 | B1 * | 1/2003 | MacLeod | F41F 3/10 114/238 |
| 8,662,441 | B2 | 3/2014 | Powell et al. | |
| 2007/0283800 | A1 * | 12/2007 | Park | F41F 3/0406 89/1.816 |
| 2008/0148927 | A1 * | 6/2008 | Alberding | F41B 11/00 89/1.817 |
| 2011/0253026 | A1 * | 10/2011 | Bossert | F41F 3/07 114/321 |
| 2012/0068009 | A1 * | 3/2012 | Bossert | F41F 3/07 244/63 |
| 2012/0205488 | A1 * | 8/2012 | Powell | B64C 39/024 244/63 |

* cited by examiner

PAYLOAD LAUNCH SYSTEM AND METHOD

CROSS-REFERENCE TO RELATED APPLICATIONS

This application claims the benefit of U.S. Provisional Patent Application Ser. No. 61/932,015 filed on Jan. 27, 2014, which is hereby incorporated by reference in its entirety.

TECHNICAL FIELD

The present disclosure relates to a system for launching an unmanned aerial vehicle or other payload.

BACKGROUND

Unmanned aerial vehicles (UAVs) are payloads in the form of remotely or autonomously controlled aircraft. UAVs tend to have lightweight airframes relative to conventional piloted aircraft, as well as advanced propulsion systems, secure data links, and associated control systems and payloads. While UAVs vary in complexity, all are characterized by an absence of a human pilot controlling the aircraft from within a cockpit. In some embodiments, a pilot may remotely control the UAV via a ground-to-air radio link. The Federal Aviation Administration (FAA) has adopted the term "Unmanned Aircraft System" (UAS) to collectively refer to the UAV, an associated ground station, and any other support equipment instrumental to successful UAV flight operations.

UAVs/UASs are traditionally used in support of intelligence, surveillance, and reconnaissance (ISR) missions. However, the traditional ISR support role has evolved from early radio-controlled drone designs to the highly sophisticated systems used on the modern battlefield, as well as in support of drug interdiction and border security missions. For instance, modern UAV/UAS mission scope has expanded to include strike missions, using airborne UAVs as command, control, and communications, and computer (C4) ISR relay nodes, search and rescue (SAR) operations, and suppression/destruction of enemy air defense (SEAD/DEAD). Because of this mission evolution, conventional UAV designs may be less than optimally effective in certain operating environments. UAVs of reduced size may be particularly useful, for instance, when deployed from a forward area of operation or other platforms or vehicles lacking extended runway surfaces. Small UAVs may also be useful in operating areas having overhead obstacles preventing conventional runway-based launch operations. However, small UAVs can also pose unique launch and deployment challenges.

SUMMARY

A payload launch system is disclosed herein for launching and deploying a small UAV or other suitable payload of the type noted above. The launch system may be configured to launch the payload from a reduced-diameter tube, for instance a 3" diameter tube of the type typically used as part of a signal ejector system in a submarine or a hatch of a small Unmanned Underwater Vehicle (UUV). Other example launch applications include deployment from a land-based platform or over the side of a surface vessel/from an aircraft into a body of water.

The launch system includes a cylindrical outer launch tube containing a rocket tube, a pressurized motor assembly, and a control system. At launch, the rocket tube is smoothly propelled from the outer launch tube via a controlled release of captive gas pressure from the pressurized motor assembly in a single gaseous thrust phase, as commanded by the control system. The duration of the resultant gaseous impulse launch of the rocket tube may be closely controlled such that the launch duration is equal to an amount of time required for the rocket tube to fully clear the outer launch tube, thereby exerting substantially lower launch forces on the payload relative to conventional launch methods.

At or prior to reaching apogee, the payload separates from the rocket tube. That is, the payload does not separate and deploy from the rocket tube until the rocket tube has reached a predetermined altitude relative to ballistic apogee. The disclosed structure and launch method are intended to help protect the payload from extreme launch forces and other environmental factors, for instance wave height/frequency in example sea-launched variants of the type described herein.

In an embodiment, the launch system includes a cylindrical outer launch tube, a payload, and a rocket tube containing the payload. The launch system also includes a control system and a pressurized motor assembly that is held stationary within the outer launch tube. The pressurized motor assembly includes a launch actuator and an accumulator housing containing a volume of compressed gas. The accumulator housing defines a vent opening having a closure whose open/closed state is controlled via the launch actuator.

The control system is in communication with the launch actuator, and is configured to transmit a launch actuation signal to the launch actuator in response to a launch request signal to thereby open the closure and thus the vent opening. This action causes a discharge of gas pressure to occur in a single gaseous thrust phase from the actuator housing into the outer launch tube, which in turn launches the rocket tube from the outer launch tube to a threshold altitude.

A method is also disclosed for launching the payload. The method in an example embodiment includes deploying a launch system, e.g., into a body of water. The launch system in this embodiment includes a rocket tube containing the payload within an outer launch tube, and a pressurized motor assembly positioned within the outer launch tube. The pressurized motor assembly includes a launch actuator as well as an accumulator housing defining a vent opening having a closure and containing a volume of compressed gas. The method includes transmitting an actuation signal to the launch actuator via a control system, and opening the closure, and thus the vent opening, in response to the actuation signal. This action allows captive gas pressure in the actuator housing to discharge into the outer launch tube in a single gaseous thrust phase, thereby launching the rocket tube from the outer launch tube to a threshold altitude via the single gaseous thrust phase. The method may include verifying that the attitude and/or position of the launch system is suitable for launch, e.g., using sensors as set forth herein to measure the angle, position with respect to a surface of water, pressure, etc., to control the timing of the launch with respect to the trailing edge of a wave or other factors that can affect the safety and accuracy of launch.

In another example embodiment, a launch system includes a cylindrical outer launch tube defining a volume and having a longitudinal axis, a rocket tube containing a payload and positioned within the launch tube, an end cap, a pressurized motor assembly, tether material, and a control system. The end cap is disposed at an end of the outer launch tube and is configured to separate from the outer launch tube in response to a threshold force from the rocket tube along the longitudinal axis. The pressurized motor assembly, which is stationary within the outer launch tube, has a launch actuator and an accumulator housing containing a volume of compressed gas. The accumulator housing defines a vent opening having a closure. The tether material connects the rocket tube to the outer launch tube, and is configured to arrest flight of the rocket tube at a threshold altitude above a surface of a body of water.

The control system in this embodiment is in communication with the launch actuator, and includes a sea water switch operable for determining that the outer launch tube is submerged below the surface of the body of water. The control system is configured to launch the rocket tube from the outer launch tube to the threshold altitude by transmitting an actuation signal to the launch actuator. When the sea water switch detects that the launch system is not submerged below the surface, the actuation signal causes the closure and thus the vent opening to open, thereby discharging gas pressure from the actuator housing into the outer launch tube.

The above features and advantages and other features and advantages of the system and method described in the present disclosure are readily apparent from the following detailed description of the best modes for carrying out the disclosure when taken in connection with the accompanying drawings.

DETAILED DESCRIPTION

Figure 7:
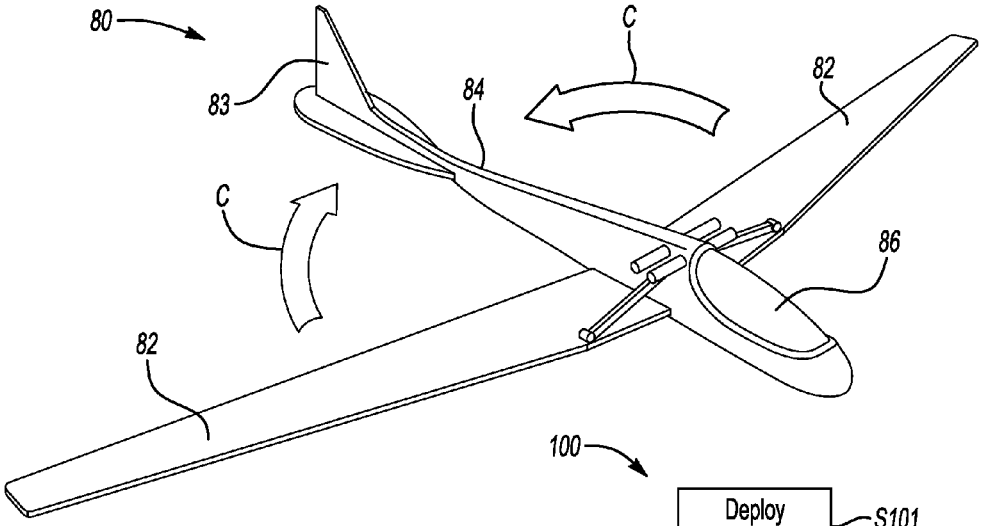
Fig-7 PRIOR ART
FIG. 7 is a prior art schematic perspective view illustration of an example payload that may be launched and deployed via the payload launch system shown in FIGS. 1-5B.

Referring to the drawings, wherein like reference numbers correspond to like or similar components throughout the several figures, example deployment sequences 10 are shown schematically in FIG. 1 for deploying a payload launch system 20 and ultimately launching a small payload 80, a prior art example of which is shown in FIG. 7 and explained below. As used herein, the term "payload" refers to any pilotless such as an airplane, glider, balloon, rotary-blade aircraft, or other vehicle, as well as airborne sensors, countermeasure devices, or any other airborne device requiring a launch force for propelling the payload 80 to a threshold altitude. The term "small" refers to the relative size of such a payload 80 with respect to conventional runway-launched and remotely piloted UAVs. When configured as an aircraft, the payload 80 may be uncontrolled after launch to operate in the manner of a glider, or it may be autonomously or remotely controlled depending on the design and application.

The number of available systems and methodologies for launching small payloads such as the payload 80 of FIG. 7 from unconventional surfaces or launch platforms lacking an extended runway surface are presently limited. Those that do exist typically utilize high-force pyrotechnics, catapults, or air-cannon devices to launch the payload directly from a launch pad. A small UAV payload, for instance, when launched via such conventional systems must be reinforced to handle high launch forces, and also must deploy almost immediately upon launch. This can unduly stress the airframe of the UAV, while the use of high-explosive pyrotechnic or other high-force launch means can themselves pose challenging launch control concerns. The present design described with reference to the Figures is intended to help solve these and other possible problems by carrying the payload 80 to within a predetermined range of apogee before smoothly deploying the payload 80 and transitioning the deployed payload 80 to flight.

Figure 1:
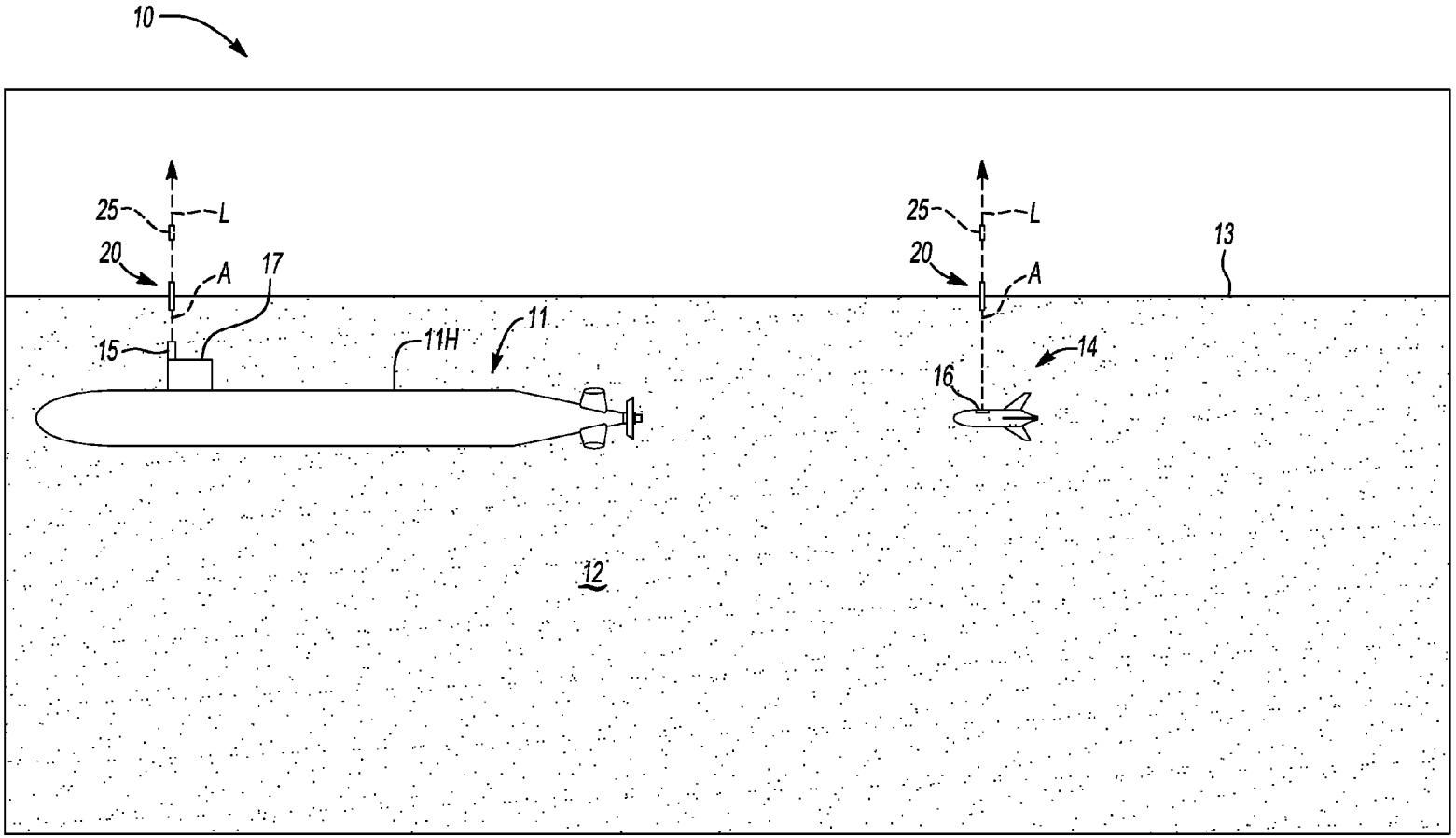
FIG. 1 is a schematic illustration of an example sequence for deploying a payload launch system from a submerged submarine or from an Unmanned Underwater Vehicle (UUV).

The deployment sequences 10 of FIG. 1 depict two possible example launches for the payload launch system 20, i.e., deployment and launch from a submerged vehicle such as a submarine 11 and from an Unmanned Underwater Vehicle (UUV) 14, e.g., a Large Displacement Unmanned Underwater Vehicle (LDUUV). As is known in the art, an LDUUV is a pier-launched and recovered UUV with open ocean functionality and over-the-horizon mission capability. However, in other embodiments the present UAV launch system 20 can be deployed according to other sequences, including but not limited to deployment from a moving helicopter, airplane, or surface vessel, or by being manually positioned by a human operator on the ground or in the water, for instance when operating from a remote forward base or a mobile operating base. Necessary variations from the deployment sequences 10 shown in FIG. 1 in such alternative embodiments will be evident to those of ordinary skill in the art.

Figure 2:
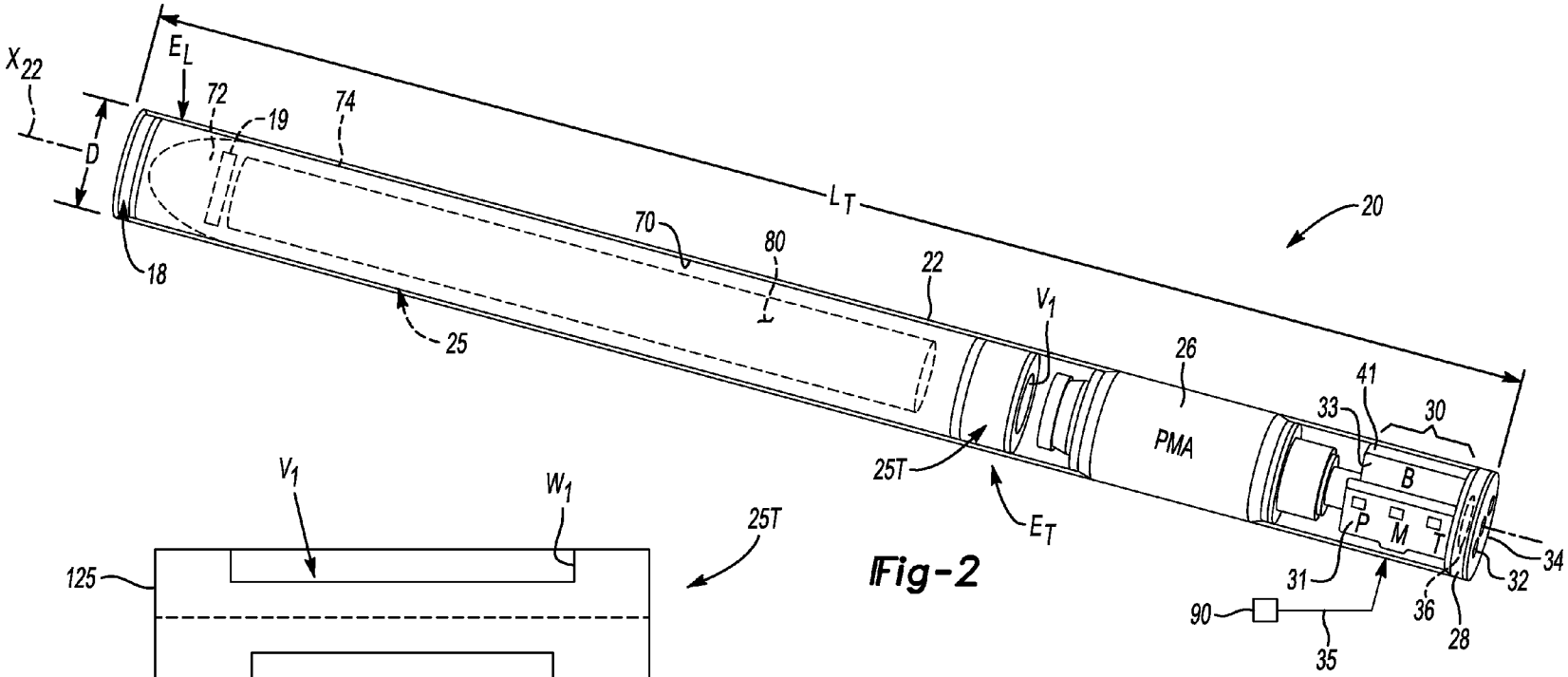
FIG. 2 is a schematic cross-sectional perspective view illustration of an example payload launch system as set forth herein.

The payload launch system 20 in all of its disclosed embodiments operates using gaseous thrust from a pressurized motor assembly (PMA) 26 as best shown in FIG. 2 and explained below. As recognized herein, gaseous thrust, via controlled adiabatic expansion, produces significantly lower acceleration and recoil forces relative to conventional pyrotechnic, catapult, and air cannon launch methods. Existing payload launch systems generate tremendous launch forces and may be able to deliver a payload to a relatively high apogee. However, higher acceleration at launch produces increased gravitational (G) forces. Higher G forces in turn can easily damage small and relatively fragile payloads of the type disclosed herein.

Additionally, the higher exit velocities of a UAV payload in particular that is not contained in a suitable payload enclosure, such as the present rocket tube 25, can result in the wings and/or other relatively fragile components of a given UAV payload being stressed and possibly damaged at launch. The design of the rocket tube 25 thus allows the wings, e.g., the wings 82 shown in the example payload 80 of FIG. 7, to deploy under closely controlled conditions.

In one of the non-limiting example launch sequences 10 of FIG. 1, the submarine 11 is submerged below a surface 13 of a body of water 12 such as a saltwater ocean or sea. The payload launch system 20 may be ejected from a suitable hatch of the submarine 11, for instance via a signal ejector tube 15 or from a hatch 16 of the UUV 14. As is well known in the art, a signal ejector tube is a 3" diameter tube having an inlet (not shown) that is typically located in a control room within the submarine 11, and which extends through a hull 11H of the submarine 11 to a superstructure deck 17. The outlet or muzzle of the signal ejector tube 15, which is typically flush with the superstructure deck 17, is shown in FIG. 1 as extending outward from the superstructure deck 17 for illustrative clarity. In its customary use, the signal ejector tube 15 ejects emergency identification signals when surfaced or submerged, usually via air pressure through a pneumatic line. The present design takes advantage of the existence of the signal ejector tube 15 to optimize UAV launch functionality relative to conventional trash disposal unit (TDU)-based launched designs.

Land-based alternative launch sequences may be readily envisioned using variations of the present UAV launch system 20 and the launch sequences 10 of FIG. 1, such as a portable shoulder/backpack system which may be carried into remote locations by infantry or special forces units operating a considerable distance from the nearest conventional runway, or in areas with overhead obstacles such as a heavy tree canopy. Such alternative configurations may forego the various sea launch design features explained herein and shown in FIG. 1.

The payload launch system 20 may be ejected from the submarine 11 or from the UUV 14 into the body of water 12 while the submarine 11 or UUV 14 travels at a calibrated speed and depth. An ascent trajectory (arrow A) of the payload launch system 20 describes the relative path of travel of the payload launch system 20 between its ejection or deployment from the submarine 11 or UUV 14 and the surface 13. Another trajectory (arrow L) describes the relative path of travel of the rocket tube 25 of the launch system 20 from the surface 13 after launch. As will be understood by those of ordinary skill in the art, the path or ascent trajectory is relative in the sense that the submarine 11 or UUV 14 is likely to move laterally from the perspective of FIG. 1 at a positive rate of speed while the payload launch system 20, which is buoyant, moves upward with respect to the surface 13, with some amount of forward motion imparted by the moving submarine 11 or UUV 14.

Upon deployment from the submarine 11, UUV 14, or other vehicle, the payload launch system 20 becomes positively buoyant and rises to the surface 13. The portions of the payload launch system 20 remaining on the surface 13 after launch of the rocket tube 25 may be recovered or scuttled as desired. The structure of the payload launch system 20 configured for launching a payload will now be described with reference to FIGS. 2-7.

Referring to FIG. 2, in a non-limiting example embodiment the payload launch system 20 is cylindrically shaped along a longitudinal axis $X_{22}$ throughout its total length ($L_T$), which may be about 39" with an outer diameter (D) of 3" in an embodiment launched via the signal ejector tube 15 of FIG. 1. However, other launch devices may require a payload launch system 20 having a different total length ($L_T$) and/or outer diameter (D). The payload launch system 20 includes an outer launch tube 22 that extends along the entirety of the total length ($L_T$) and contains the rocket tube 25, the pressurized motor assembly (PMA) 26, and a control system 30. Each component of the payload launch system 20 will now be described in turn.

The outer launch tube 22 of FIG. 2 has a circumferential inner wall 70 that forms a capsule containing the rocket tube 25. The payload 80, shown schematically in FIG. 2, is encapsulated by or contained within the rocket tube 25, with a non-limiting UAV embodiment of the payload 80 shown in perspective view in FIG. 7. A nose cone 72 may be disposed at a leading end ($E_L$) of a body 74 of the rocket tube 25 as shown, with the leading end ($E_L$) being the end of the rocket tube 25 that is oriented in the direction of flight between launch and apogee. An end cap 18 may be disposed at the end of the outer launch tube 22, with launch of the rocket tube 25 urging or forcing the end cap 18 free of the outer launch tube 22, or with an optional pyrotechnic charge 19 ejecting the end cap 18 prior to launch of the rocket tube 25 depending on the configuration. As the nose cone 72 ultimately separates from the rocket tube 25 at apogee, any friction interfaces between the nose cone 72 and the rocket tube 25 and between the end cap 18 and outer launch tube 22 may be loosely press-fitted to provide an interference fit sufficient to facilitate such separation. That is, the tolerances of the press fit and/or other properties of the friction interface securing the nose cone 72 to the rocket tube 25, and the end cap 18 to the outer launch tube 22, can be closely calibrated using the known mass and other physical properties of the rocket tube 25, as well as expected flight dynamics. The press-fitting of the end cap 18 also serves to provide a hermetic, water-tight seal during water submersion or sea-launched applications.

Figure 3:
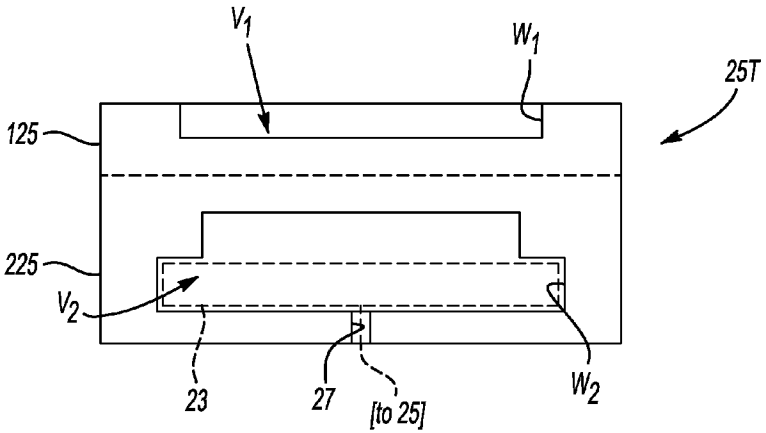
FIG. 3 is a schematic cross-sectional side view illustration of an optional tether housing that is usable with the launch system shown in FIG. 2.

The payload launch system 20 of FIG. 2 may optionally include a tether housing 25T that is welded, bonded, or otherwise securely connected to a trailing end ($E_T$) of the rocket tube 25, with the term "trailing" referring to the trailing direction of flight of the rocket tube 25 upon launch relative to the leading end ($E_L$). Referring briefly to FIG. 3, the tether housing 25T in an example configuration defines a first volume $V_1$ and a second volume $V_2$, with the first volume $V_1$ oriented toward the pressurized motor assembly 26 shown in FIG. 2. The first volume $V_1$ may be defined by a first inner circumferential wall $W_1$ while the second volume $V_2$ is similarly defined by a second inner circumferential wall $W_2$. In a possible embodiment, the tether housing 25T may be a two-piece design as shown having a first portion 125 and a second portion 225, e.g., threaded or bolted together, such that access is provided to the second volume $V_2$ when the first portion 125 is removed.

A spool of tether material 23, for instance a high-strength oriented-strand gel such as DYNEEMA or another suitable material, may be disposed within the second volume $V_2$. The tether material 23 passes from the tether housing 25T through an orifice 27 defined by or formed in the tether housing 25T, and is then securely connected at one end to the rocket tube 25. When the rocket tube 25 is launched, the tether material 23 plays out from the tether housing 25T. At apogee, tension on the tether material 23 between the rocket tube 25 and the outer launch tube 22 arrests the motion of the rocket tube 25. The payload 80, via its own forward momentum, separates from the arrested rocket tube 25 at apogee and transitions to flight. The embodiment of FIG. 3 is just one possible design for tethering the rocket tube 25 to the outer launch tube 22, with alternative designs being usable within the intended inventive scope.

Referring again to FIG. 2, the control system 30 may include a control board 31 having memory (M), a processor (P), a transceiver (T), and other required board-level components as needed. The control system 30 may also include a sea water switch 32, a battery pack (B) 33, a pressure switch 34, and inertial sensors 36, all of which may be enclosed anywhere within the outer launch tube 22 by an end cap 28. The end cap 28, unlike the end cap 18 positioned at the opposite end of the outer launch tube 22, is welded, glued, fastened, or otherwise firmly secured to the outer launch tube 22 to form a water-tight seal and a reaction surface that opposes any launch forces as described below. While shown schematically in FIG. 2 for illustrative simplicity, the various sensors 32, 34, and 36 may be positioned anywhere within the payload launch system 20, e.g., within the end cap 28, attached to the launch tube 22, as part of the control board 31, or at any other application-suitable location.

In sea-launched applications in particular, the inclusion of the optional sea water switch 32 may help the control board 31 ensure that the launch system 20 has properly exited the submarine 11 or UUV 14 of FIG. 1, or an aircraft or surface ship, and is submerged below the surface 13 of the body of water 12. The optional pressure switch 34 of FIG. 2 is operable for detecting and confirming that the payload launch system 20 is presently exposed to hydrostatic pressure. The various inertial sensors 36 may be used as part of the control system 30 to control the launch process from both a safety and an operational perspective, and may include sensors in the form of gyroscopes, accelerometers, and primary/secondary vertical axis tilt sensors which confirm that the payload launch system 20 has attained a predetermined attitude with respect to the surface 13, e.g., is vertically-oriented/sufficiently upright in the body of water 12 of FIG. 1 with respect to a predetermined attitude window known to the control system 30 and is floating on the surface 13 awaiting orders to launch. Such attitude and position may be used as prerequisites or preconditions for executing the launch such that launch occurs only when the payload launch system 20 is above the surface 13 and has the correct attitude with respect to the surface.

Settings for at least some of the sensors noted above may be adjusted wirelessly, such as by using an infrared link. The accelerometers and/or gyroscopes or gyrocompasses of the sensors 36 may also be used to provide information as to the attitude of the launch system 20 while in the signal launch tube 15 shown in FIG. 1, as well as during ascent toward the surface 13 of FIG. 1 after deployment. A digital or analog timer of the control system 30 may be used to ensure a sufficient time delay for the submarine 11 or UUV 14 of FIG. 1 to exit the launch area. The various sensors may draw electrical power from the battery pack 33, which may be configured as a lithium ion battery or any other suitable energy storage device.

The control system 30 shown in FIG. 2 is configured to automatically command a launch of the rocket tube 25 in response to a received launch request signal (arrow 35) from a transmitter 90. The launch request signal (arrow 35) may be internally generated, for instance using a timer of the control system 30, or it may be alternatively transmitted from a remote source located aboard the submarine 11 or UUV 14 of FIG. 1, an aircraft, a surface vessel, or in the possession of a human operator. The launch request signal (arrow 35) is received by a launch actuator 41 of the control system 30, which then triggers a launch of the rocket tube 25 via a launch actuation signal (arrow 135).

Figure 4:
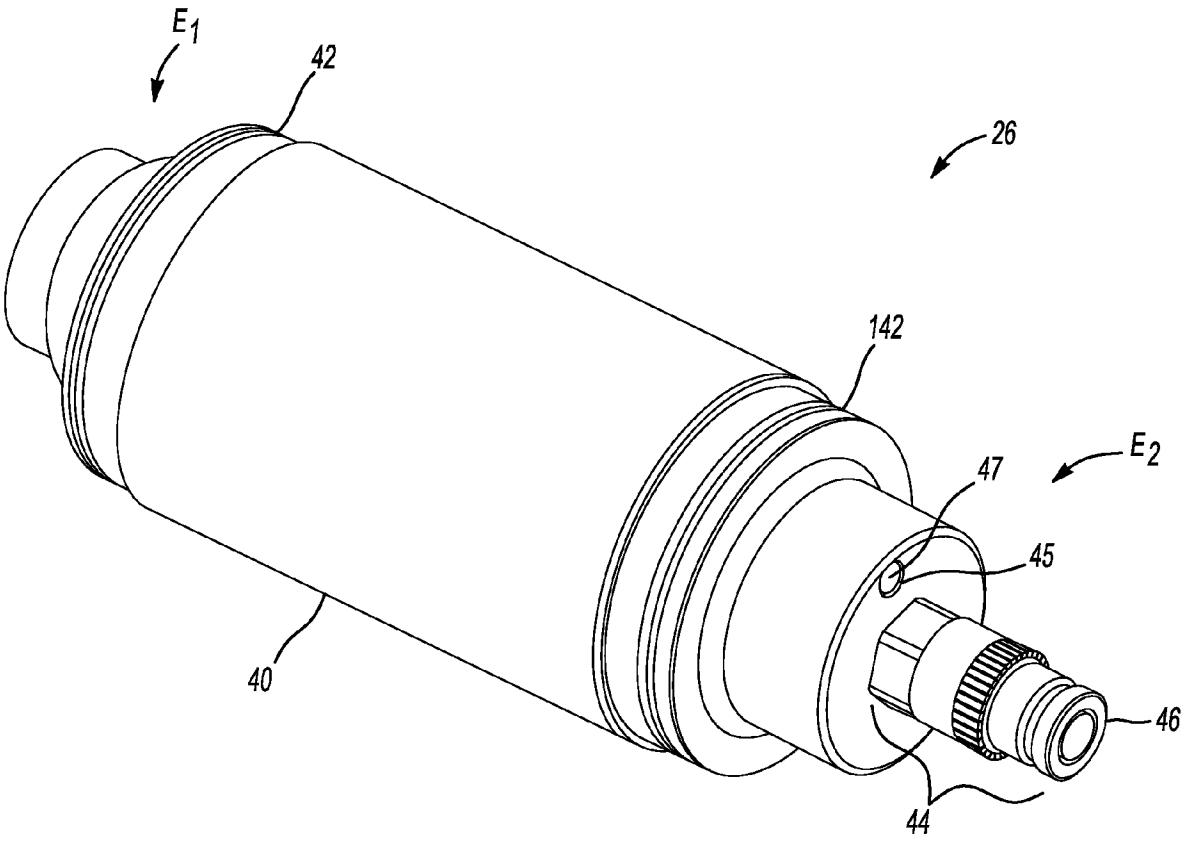
FIG. 4 is a schematic perspective view illustration of an example pressurized motor assembly for the payload launch system of FIG. 2.

Referring to FIGS. 2 and 4, the rocket tube 25 is launched from the outer launch tube 22 using a gaseous impulse force delivered from the pressurized motor assembly 26. The pressurized motor assembly 26 operates by quickly releasing gas pressure into the internal volume of the outer launch tube 22 near the rocket tube 25. The rapid increase in pressure within the outer launch tube 22 propels and translates the rocket tube 25 along the longitudinal axis $X_{22}$ shown in FIG. 2, through, and ultimately out of the outer launch tube 22 and toward apogee. The pressurized motor assembly 26 remains in the outer launch tube 22 after launch of the rocket tube 25, along with the control system 30, and therefore can be reused after launch or scuttled regardless of whether or not the payload 80 of FIG. 7 is ultimately recovered.

The pressurized motor assembly 26 shown in FIG. 4 may include an accumulator housing 40 having a first end ($E_1$), a second end ($E_2$), a fill nozzle 44, and o-ring seals 42 and 142. The o-ring seals 42 and 142 circumscribe the accumulator housing 40 and provide a static seal against the circumferential inner wall 70 shown in FIG. 1 when the pressurized motor assembly 26 is disposed within the outer launch tube 22 of FIG. 2. The accumulator housing 40 may be embodied as a pressure vessel constructed of metal, high-strength plastic, carbon fiber, or other suitable materials, and contains a volume of compressed inert gas such as carbon dioxide ($CO_2$), nitrogen ($N_2$), or air. The term "compressed" as used herein refers to pressure levels that are sufficient for launching the rocket tube 25 of FIG. 2 to a desired apogee. By way of illustration, in a launch assembly 20 having a weight of about 10 pounds, example pressure levels of 500-1050 psig may be used to reach an apogee of about 60-70 m, with pressures up to 1300 psig in some embodiments being possible based on hydrostatic testing and industry standard margins.

The fill nozzle 44 positioned at the second end $E_2$ is oriented facing away from the rocket tube 25 of FIG. 2 when the pressurized motor assembly 26 is captive within the outer launch tube 22. To charge the pressurized motor assembly 26, a fill orifice 46 of the fill nozzle 44 may be connected to a supply of pressurized gas, such as a pre-charged industrial fill tank or gas compressor. The second end $E_2$ defines a vent hole 45 having a door or other closure 47, with the vent hole 45 shown in a charged state in FIG. 4 with the closure 47 in a closed position. The launch actuator 41 shown schematically in FIG. 2 is configured to open or remove the closure 47 to allow pressure in the accumulator housing 40 to vent from the second end $E_2$ when pressure is discharged from the first end $E_1$. Operation and internal construction of the pressurized motor assembly 26 of FIG. 4 will now be described in further detail with reference to FIGS. 5A and 5B.

Figure 5A:
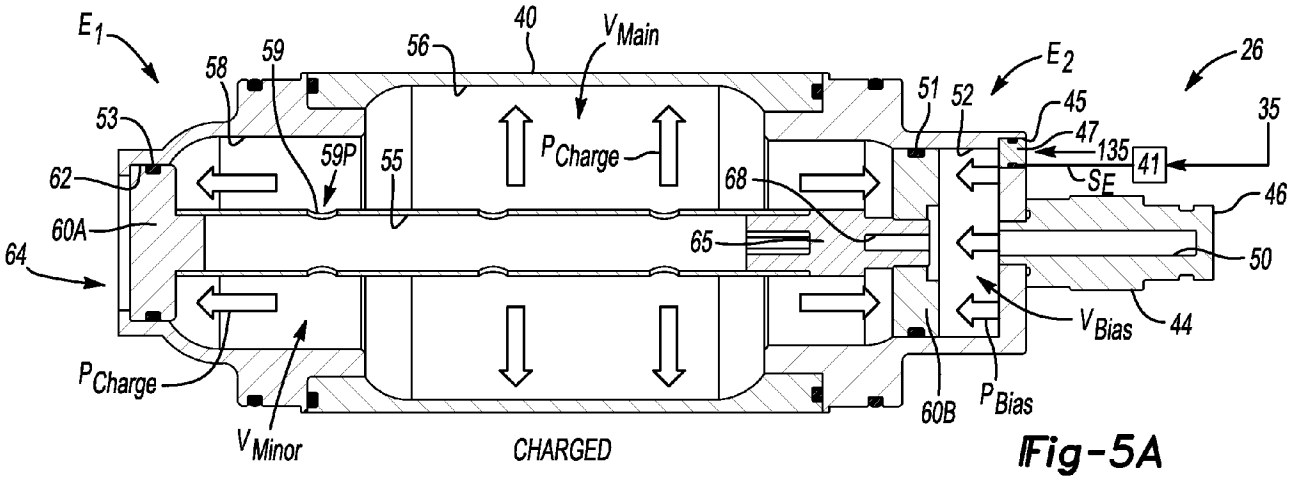
FIG. 5A is a schematic side view illustration showing internal detail of the pressurized motor assembly of FIG. 4 in a charged state.

FIG. 5A shows the example pressurized motor assembly 26 of FIG. 4 in a charged state. That is, the accumulator housing 40 in this embodiment is pressurized with a charge pressure ($P_{CHARGE}$) of 500-1050 psig or another suitable pressure. In a possible embodiment, the accumulator housing 40 defines a main volume ($V_{MAIN}$) that in turn is defined by an inner wall 56, a minor volume ($V_{MINOR}$) that is defined by another inner wall 58, and a biasing volume ($V_{BIAS}$) defined at the second end ($E_2$) by an inner wall 52. The accumulator housing 40 also includes a one-way valve 65 disposed along a perforated conduit 59 having an inner wall 55 and holes or perforations 59P and another center channel 68. When compressed gas is connected to the fill nozzle 44, the pressurized gas enters and flows through a channel 50 in the fill nozzle 44, through the center channel 68 of the one-way valve 65, through the perforated conduit 59, and into the main and minor volumes ($V_{MAIN}$, $V_{MINOR}$) via the perforations 59P.

When gaseous charge pressure (arrows $P_{CHARGE}$) enters the minor volume ($V_{MINOR}$), a T-shaped stopper 60A seals against a radial face 62 of the accumulator housing 40. A dynamic seal 53 such as an o-ring circumscribes the T-shaped stopper 60A to prevent leakage of the charge pressure (arrows $P_{CHARGE}$). The T-shaped stopper 60A plugs an exhaust port 64 at the first end ($E_1$) of the accumulator housing 40 when the pressurized motor assembly 26 is fully charged.

In the charged state of FIG. 5A, another stopper 60B connected to the one-way valve 65 at the second end ($E_2$) is moved axially away from the fill nozzle 44. As with the T-shaped stopper 60A, the stopper 60B may include a dynamic seal 51, e.g., an o-ring that circumscribes the stopper 60B to prevent leakage of biasing gas pressure (arrows $P_{BIAS}$). The dynamic seal 51 seals against the inner wall 52 defining the biasing volume ($V_{BIAS}$). Once fully charged, the closure 47 seals the vent opening 45. In an example embodiment, the closure 47 may be held closed via a launch actuator 41 in the form of a sacrificial element ($S_E$), for instance a fuse which is opened or severed via a calibrated electrical current from the battery (B) 33 of FIG. 2. Other suitable embodiments of the launch actuator 41 include a spring having a return force that is less than the expected venting pressures described below with reference to FIG. 5B, a solenoid or other linear actuator, a shape memory alloy device, or the like.

Figure 5B:
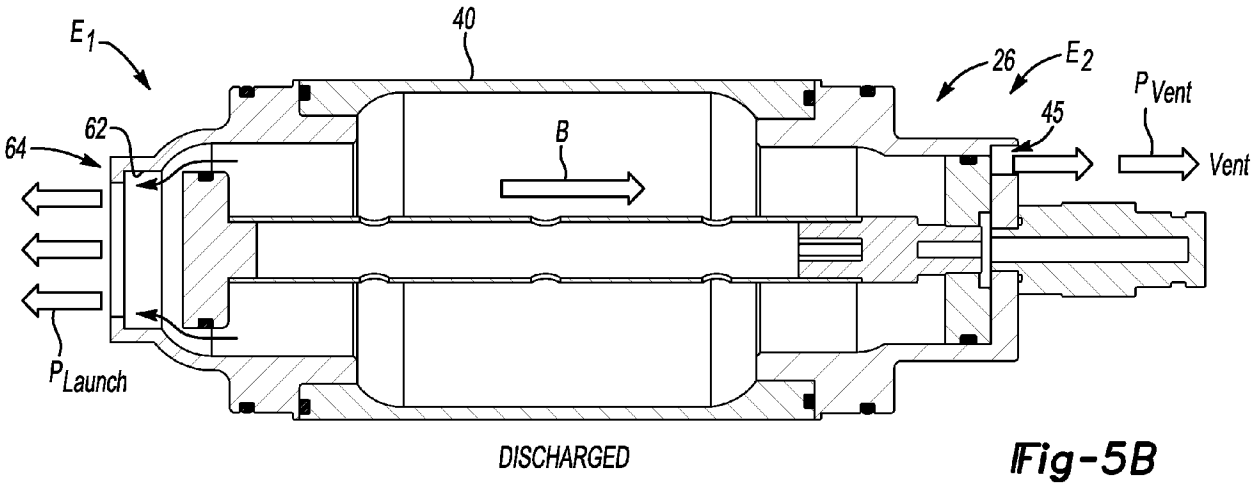
FIG. 5B is a schematic side view illustration of the pressurized motor assembly of FIG. 5A in a discharged state.

A discharged state of the pressurized motor assembly 26 is shown in FIG. 5B. When the launch request signal (arrow 35) of FIG. 5A is transmitted by the control system 30 of FIG. 2 to the launch actuator 41, the closure 47 quickly opens. As a result, captive gas pressure in the biasing volume ($V_{BIAS}$) quickly vents though the vent opening 45 to atmosphere as indicated by arrows $P_{VENT}$. Captive pressure in the main volume ($V_{MAIN}$) and the minor volume ($V_{MINOR}$) moves the stoppers 60A and 60B in the direction of arrow B, thereby allowing the respective main and minor volumes ($V_{MAIN}$, $V_{MINOR}$) to exhaust pressure via the exhaust port 64 as a launch pressure ($P_{LAUNCH}$). The launch pressure ($P_{LAUNCH}$) acts on the rocket tube 25 of FIG. 2, such as by entering volume $V_1$ of the tether housing 25T shown schematically in FIG. 2. As the rocket tube 25 is translatable within the outer launch tube 22, i.e., freely moveable along the longitudinal axis ($X_{22}$) of the outer launch tube 22, the launch pressure ($P_{LAUNCH}$) quickly forces the rocket tube 25 out of the outer launch tube 22 and allows the rocket tube 25 to ascend toward apogee solely via the gaseous thrust provided by the discharging gas pressure.

In an alternative configuration to that shown in FIGS. 5A and 5B, omitted for simplicity but understood by those of ordinary skill in the art, the perforated conduit 59 and valves 65 may be replaced with a small orifice through the stopper 60B. In such an embodiment, charging air flow through the hole in the stopper 60B and the pressures in the cavities equalize. Upon opening of the vent opening 45, the stopper 60B moves faster than the pressure can equalize through the small hole, thus allowing the air to be released through the exhaust port 64. While the operating principle is essentially the same as that described above with reference to the example design of FIGS. 5A and 5B, such a simplified design might be advantageous in terms of component count and speed.

Figure 6:
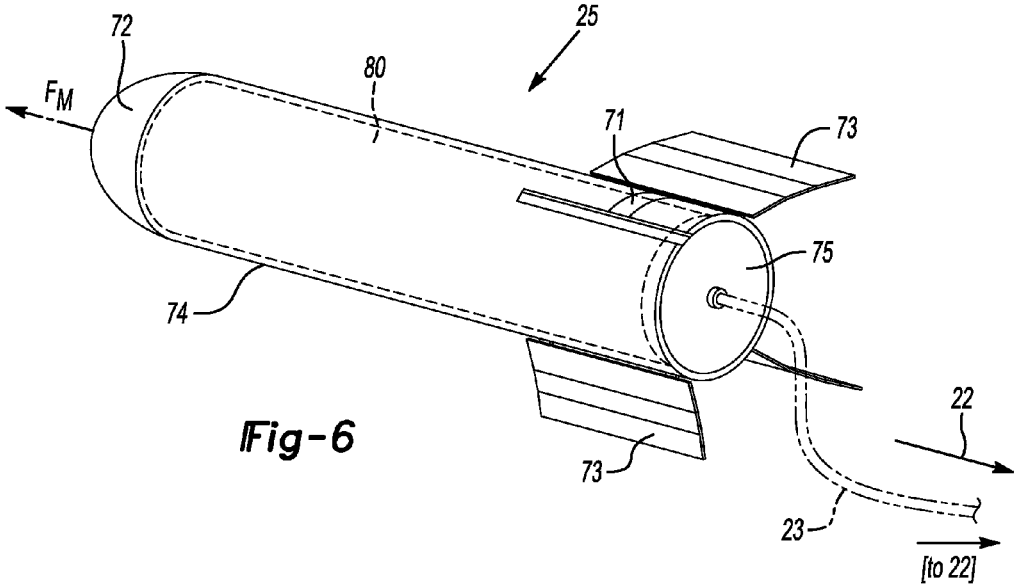
FIG. 6 is a schematic perspective view illustration of an example rocket tube in flight after launch and prior to deployment of the payload.

Referring to FIG. 6, the rocket tube 25 is shown in perspective view upon becoming fully airborne. In a possible embodiment, guide fins 73 may deploy via a spring 71, for instance a leaf spring, spring-loaded hinge, or other suitable biased device, soon after the rocket tube 25 exits the outer launch tube 22 of FIG. 2. In such an embodiment, the spring 71 may be connected between the guide fins 73 and body 74 of the rocket tube 25 and folded for stowage of the guide fins 73 against the body 74. The number and configuration of the guide fins 73 can be selected to provide the rocket tube 25 with sufficient flight stability, possibly including forgoing use of some or all of the guide fines 73 shown in FIG. 6.

The tether material 23 is shown in phantom as being attached to a floor 75 or other stationary member of the rocket tube 25. The other end of the tether material 23 is connected to the outer launch tube 22 of FIG. 2 as noted above, which remains positioned after launch on the surface 13 of FIG. 1 or another surface in ground or air-based launches. Tension on the tether material 23 as the rocket tube 25 nears apogee ultimately arrests the flight of the rocket tube 25. The forward momentum (arrow $F_M$) of the payload 80 contained in the rocket tube 25 allows the payload 80 to continue along the flight trajectory of the now-arrested rocket tube 25, urge the nose cone 72 from the body 74, and thereby smoothly separate from the rocket tube 25. Alternatively, the tether material 23 may be dispensed with altogether, and the rocket tube 25 may be permitted to reach a predetermined percentage of apogee or full apogee, thereafter deploying the payload 80 via a mechanical device or a stored energy payload ejection device, for instance as the rocket tube 25 begins its descent. In other embodiments, the payload 80 may deploy from another portion of the rocket tube 25, suitably modified, such as from the rear or a side compartment in an alternative clamshell design.

Apogee in a signal ejector tube-launched embodiment may be at least about 73 meters (m) above the surface 13 of FIG. 1 or other launch surface. Maximum velocity of the rocket tube 25 in this non-limiting example embodiment is approximately 37-45 meters per second (mps) at approximately 0.5 m above the surface 13 of FIG. 1. Under such constraints, a maximum force of about 300 G is placed on the payload 80. Actual flight dynamics and resultant forces will vary depending on the size and mass of the payload 80, and thus the gas pressure in the pressurized motor assembly 26. However, in all embodiments it is expected that the threshold altitude is at least sufficient to clear any immediate surface features such as waves, trees, power lines, buildings, or other obstacles. Practically speaking, this altitude will ordinarily be at least 20 m.

Referring to FIG. 7, an example prior art small payload 80 in the form of a small UAV is shown which may be delivered to apogee via the rocket tube 25 of FIG. 6. The payload 80 may be shaped like a conventional airplane, i.e., having wings 82, a tail section 83, a fuselage 84, and a nose section 86. The wings 82 may be spring-loaded and/or segmented to allow the wings 82 to sweep and fold parallel to the fuselage 84 as indicated by arrows C for easy insertion into the rocket tube 25 shown in FIG. 6. Thus, once the payload 80 is clear of the rocket tube 25, the wings 82 can freely unfold and lock into place. Other embodiments may include wings 82 that wrap circumferentially around the fuselage 84 and then freely unwrap and lock into place whenever the payload 80 is ejected from the rocket tube 25.

The example payload 80 of FIG. 7 thereafter may act in whatever manner it is configured, for instance functioning as a glider or as a remotely or autonomously piloted vehicle. As an example of a possible controlled flight design, the nose section 86 may be equipped with a receiver and a flight controller (not shown), and the wings 82 and tail section 83 may be equipped with a rudder, elevators, ailerons, flaps, trim tabs, and other necessary flight control surfaces which may be positioned using commands from the flight controller. The payload 80 may also be equipped with C4ISR or other sensors suitable for capturing and recording/relaying collected information, such as communications, electro-optical, infrared, and/or radar imagery, signals intelligence, telemetry information, and the like.

Figure 8:
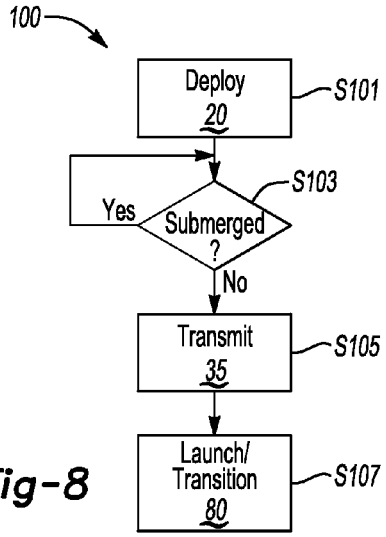
FIG. 8 is a flow chart of an example method for launching a payload via a payload launch system of the type described herein.

Referring to FIG. 8, an example method 100 is shown for launching the payload 80 noted above. Step S101 may entail deploying the payload launch system 20 described hereinabove into and below the surface 13 of the body of water 12 of FIG. 1, e.g., from the submarine 11, the UUV 14, or an aircraft (not shown). While in this step, the various sensors 32, 34, 36 of FIG. 2 collect their respective information as described above, and may stream this information back to the launch site or other remote location or use it strictly onboard via the control system 30 depending on the embodiment. The method 100 proceeds to step S103 when the payload launch system 20 has deployed and is below the surface 13.

Step S103 includes determining whether the payload launch system 20 remains submerged beneath the surface 13 of the body of water 12. Step S103 may entail using the sea water switch 32 shown schematically in FIG. 2 to detect the presence of sea water and/or using the pressure sensor 34 to detect hydrostatic pressure. Step S103 may include determining whether the payload launch system 20 has attained a predetermined attitude with respect to the surface 13 shown in FIG. 1. As sea-launched variants are contemplated within the scope of this disclosure, part of step S103 may be to use the outputs from the inertial sensors 36 to predict the orientation and vertical position of the launch system 20 relative to encountered wave motion at the surface 13 of FIG. 1 prior to commanding a launch such that launch is timed for when the launch system 20 is within a predetermined launch angle window, e.g., within ±10 to 15 degrees of true vertical. The method 100 proceeds to step S105 when the payload launch system 20 is no longer submerged beneath the surface 13, and has attained the predetermined attitude suitable for a launch.

At step S105, the method 100 includes transmitting the launch request signal (arrow 35 of FIG. 5A) to the control system 30, and in turn, the launch actuation signal (arrow 135 of FIG. 5A) to the launch actuator 41, which may include the sacrificial element $S_E$, also via the control system 30. The method 100 thereafter proceeds to step S107.

At step S107, the closure 47 of the vent opening 45 is separated or opened in response to receipt of the launch actuation signal (arrow 35). The opening of the closure 47 allows pressure from the actuator housing 40 to rapidly discharge from the first end ($E_1$) of FIG. 4 into the outer launch tube 22 of FIG. 2, thereby launching the rocket tube 25 from the outer launch tube 22 solely via gaseous thrust. The rocket tube 25 ascends to the threshold altitude above the surface 13 of the body of water 12 shown in FIG. 1, whereupon the payload 80 separates from the rocket tube 25 and transitions to flight.

The launch method 100 disclosed herein provides an extended gaseous thrust phase at a force level sufficient for launching the rocket tube 25 containing the payload 80 as described above. All launch phases are performed via gaseous thrust. The rocket tube 25 and the payload 80 are therefore launched with closely controlled forces of acceleration, and with substantially lower levels of recoil, relative to conventional pyrotechnic launch systems and catapults as noted above. The design of the rocket tube 25 also allows the payload 80 to be deployed at higher altitudes relative to conventional payload launch methods, thus reducing initial power consumption by the payload 80 and enabling extended range or flight duration.

Additionally, the various sensors noted above provide safety interlocks as well as launch triggers once the launch system 20 has reached the surface 13 of FIG. 1. The launch system 20 combines the outputs from all of the sensors to ensure that it is safe during handling and will not arm until installed and subsequently ejected. The presence of salt water and high pressure may be required in a particular embodiment so as to activate the system 20 in a sea-launched application. The sensors 36, i.e., a series of tilt sensors, accelerometers, and proximity sensors, serve to confirm that the launch system 20 has been properly deployed prior to launch. The pressure switch is used to detect that the launch system 20 has reached the surface 13. The accelerometers of sensors 36 are used to determine the orientation and vertical position of the launch system 20 relative to wave action at the surface 13. The launch system 20 will only generate a "clear to launch" signal or otherwise is placed in a clear to launch state once it has been ascertained that the launch system 20 is vertical to within a pre-configured angular window and the launch system 20 is simultaneously deemed to be on a trailing edge of a wave, and thus above the surface 13.

While the best modes for carrying out the present disclosure have been described in detail, those familiar with the art to which the disclosure relates will recognize various alternative designs and embodiments that fall within the scope of the appended claims.

The invention claimed is:

1. A payload launch system comprising:

a cylindrical outer launch tube having a longitudinal axis;

a payload;

a rocket tube containing the payload, wherein the rocket tube is contained within the outer launch tube;

a pressurized motor assembly held stationary within the outer launch tube, wherein the pressurized motor assembly includes a launch actuator and an accumulator housing containing a volume of compressed gas and defining a vent opening having a closure; and a control system in communication with the launch actuator;

wherein the control system is configured to transmit a launch actuation signal to the launch actuator in response to a launch signal to thereby open the closure of the vent opening and thereby cause a discharge of the compressed gas from the actuator housing into the outer launch tube, thereby translating the rocket tube along the longitudinal axis and launching the rocket tube from the outer launch tube in a single gaseous thrust phase, such that the pressurized motor assembly remains in the outer launch tube after launch of the rocket tube.

2. The payload launch system of claim 1, further comprising tether material connecting the rocket tube to the outer launch tube, wherein flight of the rocket tube is arrested at a threshold altitude via tension on the tether material.

3. The payload launch system of claim 1, wherein the compressed gas is selected from the group consisting of carbon dioxide, nitrogen, and air.

4. The payload launch system of claim 1, wherein the outer launch tube has a diameter of 3 inches and a length of 39 inches.

5. The payload launch system of claim 1, wherein the launch actuator includes a sacrificial element holding the closure in a closed position, and wherein the launch actuation signal severs the sacrificial element to thereby open the closure.

6. The payload launch system of claim 1, wherein the control system includes at least one of a sea water switch operable for determining that the payload launch system is submerged below a surface of a body of water and a pressure switch operable for confirming that the payload launch system is exposed to hydrostatic pressure.

7. The payload launch system of claim 1, further comprising an end cap disposed at an end of the outer launch tube and configured to separate from the outer launch tube in response to a threshold force from the rocket tube along the longitudinal axis.

8. The payload launch system of claim 7, wherein the payload is an unmanned aerial vehicle.

9. The payload launch system of claim 1, further comprising:

an end cap disposed at an end of the outer launch tube and configured to separate from the cylindrical outer launch tube in response to a threshold force from the rocket tube along the longitudinal axis; and tether material connecting the rocket tube to the outer launch tube, wherein the tether material is configured to arrest flight of the rocket tube at a threshold altitude;

wherein the control system includes a sea water switch operable for determining that the launch system is submerged below a surface of a body of water and a set of inertial sensors for determining an attitude of the launch system with respect to the surface;

wherein the control system is configured, when the sea water switch detects that the launch system is not submerged below the surface of the body of water and the attitude of the launch system is within a calibrated window, to launch the rocket tube from the outer launch tube to the threshold altitude, only when the launch system is not submerged and the attitude is within the calibrated window, by transmitting a launch actuation signal to the launch actuator, and wherein the launch actuation signal opens the closure of the vent opening and causes a discharge of the compressed gas from the actuator housing into the outer launch tube in the single gaseous thrust phase, thereby translating the rocket tube along the longitudinal axis and launching the rocket tube from the outer launch tube.

10. The payload launch system of claim 9, wherein the outer launch tube has a diameter of 3 inches and a length of 39 inches.

11. The payload launch system of claim 9, wherein the launch actuator includes a sacrificial element holding the closure in a closed position, and wherein the actuation signal is an electrical current that is sufficient for severing the sacrificial element.

12. The payload launch system of claim 9, wherein the payload is an unmanned aerial vehicle.

13. A method for launching a payload, comprising:

deploying a payload launch system that includes a launch actuator, a pressurized motor assembly having an accumulator housing containing a volume of compressed gas, and a rocket tube containing the payload within a cylindrical outer launch tube having a longitudinal axis;

transmitting a launch actuation signal to the launch actuator via a control system in response to a launch request signal; and discharging the compressed gas from the accumulator housing into the outer launch tube to thereby launch the rocket tube from the outer launch tube to a threshold altitude via gaseous thrust from the pressurized motor assembly in a single gaseous thrust phase, such that the pressurized motor assembly remains in the outer launch tube after the launch of the rocket tube.

14. The method of claim 13, wherein deploying the payload launch system includes ejecting the payload launch system into a body of water.

15. The method of claim 14, further comprising determining, via a sea water switch of the control system, that the outer launch tube is not submerged below a surface of the body of water before transmitting the launch actuation signal, and via an inertial sensor whether the payload launch system has attained a predetermined attitude with respect to the surface, and discharging the compressed gas in response to the launch actuation signal only when the payload launch system has attained the predetermined attitude above the surface.

16. The method of claim 14, wherein deploying the payload launch system includes ejecting the payload launch system into the body of water via a signal ejector tube of a submarine submerged beneath a surface of the body of water.

17. The method of claim 13, further comprising:

connecting the rocket tube to the outer launch tube via tether material;

arresting flight of the rocket tube near the threshold altitude via tension on the tether material; and expelling the payload from the rocket tube via momentum of the rocket tube.

18. The method of claim 13, wherein the compressed gas is selected from the group consisting of carbon dioxide, nitrogen, and air.

19. The method of claim 13, wherein the launch actuator includes a sacrificial element, and wherein transmitting the launch actuation signal includes severing the sacrificial element via an electrical current.

20. The method of claim 13, further comprising determining, via a pressure switch of the control system, that the payload launch system is exposed to hydrostatic pressure before transmitting the launch actuation signal.

* * * * *